US007893886B2

(12) United States Patent
Schadler

(10) Patent No.: US 7,893,886 B2
(45) **Date of Patent: *Feb. 22, 2011**

(54) CIRCULARLY POLARIZED BROADCAST PANEL SYSTEM AND METHOD USING A PARASITIC DIPOLE

(75) Inventor: John L. Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 422 days.

This patent is subject to a terminal disclaimer.

(21) Appl. No.: 10/914,092

(22) Filed: Aug. 10, 2004

(65) Prior Publication Data

US 2006/0033670 A1 Feb. 16, 2006

(51) Int. Cl.
*H01Q 13/00* (2006.01)

(52) U.S. Cl. ..... 343/767

(58) Field of Classification Search ..... 343/817, 343/818

See application file for complete search history.

(56) References Cited

U.S. PATENT DOCUMENTS

| | | | | |
|---|---|---|---|---|
| 2,691,102 | A * | 10/1954 | Wayne | 343/800 |
| 4,062,019 | A | 12/1977 | Woodward et al. | 343/797 |
| 4,583,098 | A | 4/1986 | Sikina, Jr. | 343/771 |
| 4,590,480 | A * | 5/1986 | Nikolayuk et al. | 343/771 |
| 4,899,163 | A | 2/1990 | Schadler | 343/767 |
| 5,278,569 | A * | 1/1994 | Ohta et al. | 343/700 MS |
| 6,424,309 | B1 * | 7/2002 | Johnston et al. | 343/767 |
| 6,762,729 | B2 * | 7/2004 | Egashira | 343/767 |
| 6,762,730 | B2 * | 7/2004 | Schadler | 343/770 |
| 7,081,860 | B2 * | 7/2006 | Schadler et al. | 343/767 |
| 2004/0239567 | A1 * | 12/2004 | Van Der Poel | 343/700 MS |

* cited by examiner

*Primary Examiner*—Tho G Phan
(74) *Attorney, Agent, or Firm*—Baker & Hostetler LLP

(57) ABSTRACT

A bow-tie slot panel antenna is described, having a parasitic element positioned at an orientation from the slot to generate orthogonal fields. By adjusting the coupling ratios, dimensions and angle of orientation of the parasitic element, circularly polarized fields can be effectively produced, using the panel antenna as the primary radiator.

25 Claims, 5 Drawing Sheets

20

30

CIRCULARLY POLARIZED BROADCAST PANEL SYSTEM AND METHOD USING A PARASITIC DIPOLE

FIELD OF THE INVENTION

The present invention relates generally to circularly polarized broadcast antennas. More particularly, the present invention relates to a circularly polarized broadcast antenna using an askew radiating element parasitically fed by a slotted panel.

BACKGROUND OF THE INVENTION

Slotted antenna systems are well known in the art as providing radiation patterns similar to dipole antennas. Antennas using a slot or a series of slots in a flat, electrically large surface are typically referred to as panel antennas. Panel antennas having a bow-tie-shaped slot are known to be multiband (based on the width and shape of the bow-tie). However, bow-tie panel antennas are not known for propagating electromagnetic radiation having a circular polarization.

Therefore, there has been a longstanding need in the antenna community for a panel antenna to provide circularly-polarized electromagnetic radiation.

SUMMARY OF THE INVENTION

The foregoing needs are met, to a great extent, by the present invention, wherein in one aspect an apparatus that in some embodiments provides a panel antenna system is devised that enables the broadcast of (circularly polarized or elliptically polarized electromagnetic radiation by parasitic coupling to a semi-orthogonal resonating element. In accordance with one embodiment of the present invention, a broadcast panel antenna is provided, comprising, a substantially flat conductive panel having a bow-tie slot therein, and a parasitic element disposed substantially parallel to a plane of the panel, and displaced from the plane of the panel, and oriented at an angle that is skewed from an axis of symmetry of the bow-tie slot, wherein a midpoint of the parasitic element substantially crosses the axis of symmetry.

In accordance with another embodiment of the present invention, a panel antenna is provided, comprising, a first substantially flat broadband radiating means for radiating predominant first electromagnetic field orientation, and a second radiating means for radiating predominant second electromagnetic field orientation, an imaging means for providing a ground plane effect, wherein the second radiating means is disposed substantially parallel to and displaced from a plane of the first radiating means, and oriented at an angle that is skewed from an axis of symmetry of the first radiating means and a midpoint of the first radiating means substantially crosses the axis of symmetry, and the imaging means is disposed substantially parallel to the first radiating means and on an opposite face of the first radiating means from the second radiating means.

In accordance with yet still another embodiment of the present invention, a method for radiating a circularly polarized signal is provided, comprising the steps of, generating a first predominant electromagnetic field orientation vector in a slotted panel radiator, coupling the first vector to a parasitic element, and generating a second predominant electromagnetic field orientation vector from the parasitic element by orientating the parasitic element off-axis from the first vector, wherein the combination of the first and second vector produces a circularly polarized electromagnetic field.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
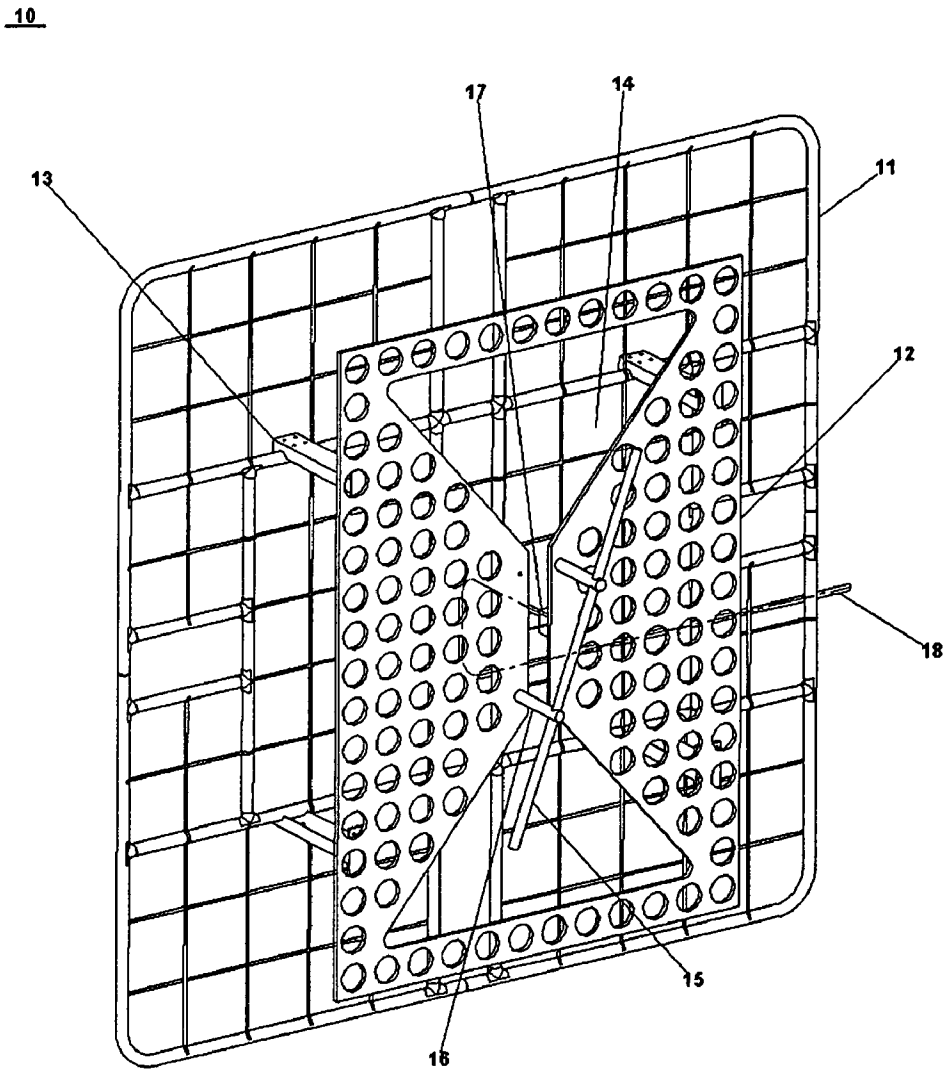
FIG. 1 is a perspective view of circularly polarized panel antenna according to a preferred embodiment of the invention.
Figure 2:
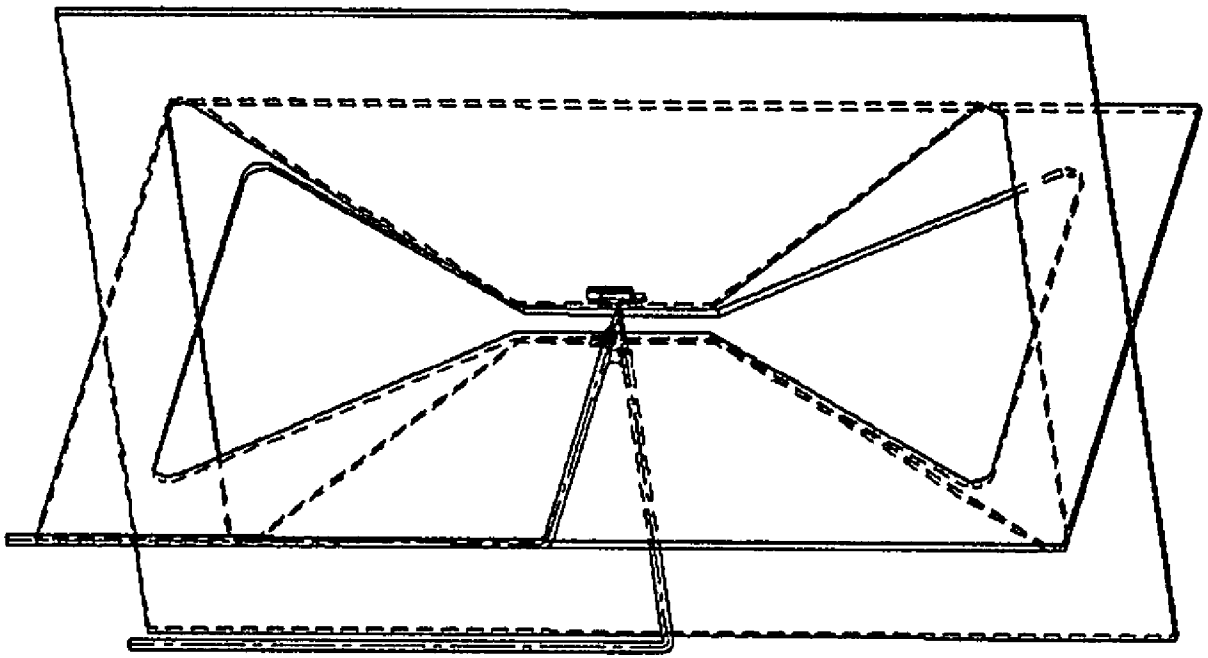
FIG. 2 is a perspective view illustrating a horizontally polarized crossed bow-tie panel antenna.

The invention will now be described with reference to the drawing figures, in which like reference numerals refer to like parts throughout.

Various attempts have been made in the antenna community to modifiy the simple structure provided by a panel antenna to have multiple degrees of freedom. The closest approach known using panel antennas is discussed in U.S. Pat. No. 6,762,730, titled "Crossed Bow-tie Slot Antenna," by the present inventor, John Schadler, the disclosure of which is hereby incorporated by reference in its entirety. This approach superimposes bow-tie slot panels in separate planes of azimuth to form complementary electromagnetic field vectors from the independent slot panels. However, as detailed in the U.S. Pat. No. 6,762,730, the resultant pattern provides omni-directional horizontal field components, rather than circular polarization.

Alternatively, ring-style or crossed dipole antennas are known to provide circular polarization. However, these antenna systems require sophistated radiating element shapes which may be difficult to manufacture or tune, as well as additional feed structures to feed the respective radiating elements.

FIG. 1 is a prospective front view of an exemplary embodiment 10 according to a preferred embodiment of this invention. FIG. 1 illustrates a circularly-polarized panel 12 using a skewed parasitic dipole 15. The exemplary embodiment 10 contains a ground plane/backscreen 11 supporting a panel 12 via panel/radiator stand-offs 13. The radiator/panel stand-offs 13 provides mechanical support for the panel 12 as well as acts as a grounding conduit for the backscreen 11, either by direct connection or by a grounding cable (not shown). The panel 12 contains a bow-tie like slot 14 centrally located therein. The bow-tie like slot 14 is vertically oriented to provide horizontal electric field polarization across the aperture formed by the bow-tie like slot 14. The plate 12 is punctuated with holes to minimize weight and reduce wind drag. The parasitic dipole 15 is positioned over the aperture of the bow-tie slot 14, substantially parallel to the face of the plate 12 with a slightly skewed orientation with respect to the vertical axis of the bow-tie like slot. The parasitic dipole 15 is attached to the plate 12 via a pair of dielectric dipole supports 16.

The bow-tie slot 14 of the circularly-polarized antenna 10 of FIG. 1 is excited by a feedpoint voltage or current 17 placed at a midpoint or near midpoint of the center of the slot 14. The feedpoint 17 is coupled to a transmitter (not shown) via an input feed cable 18 or conduit. Several methods are available for exciting a slot aperture, one such method being described in the incorporated by reference U.S. Pat. No. 6,762,730, titled "Cross Bow-tie Slot Antenna," by the present inventor, John Schadler. Since there are numerous ways to excite a slot, discussion of this subject is deferred to textbooks that describe such excitation modes, such as "Foundations for Microwave Engineering", by R. E. Collin, McGraw-Hill, 1966, and "Antenna Theory and Design", by Stuzman & Thiele, John Wiley & Sons, 1981.

In operation, the exemplary embodiment 10 of FIG. 1 generates circularly-polarized radiation by a combination of the predominantly horizontal electric fields emanating from the bow-tie slot 14 and the vertical electric field components from the skewed parasitic dipole 15. Since the parasitic dipole 15 is positioned in an a skewed manner from the vertical orientation of the slot 14, coupling will occur between the emanating slot field vectors and the parasitic dipole 15. The coupled energy will be re-oriented from the horizontal plane to the "skewed" plane by the parasitic dipole 15 and will be reradiated by the parasitic dipole 15 in an orientation parallel to the orientation of the parasitic dipole 15. Due to the skewed orientation of the parasitic dipole 15, a vertical radiating field component will be generated which complements the horizontal component from the bow-tie slot 14. Based on the coupling efficiency of the parasitic dipole 15 to the slot 14, and the orientation/distance of the parasitic dipole 15 from the face of the slot 14, varying amounts of vertical or orthogonal field components can be generated. By adjusting the above attributes of the parasitic dipole 15, an increasing or decreasing amount of the orthogonal field component can be generated. With the generation of orthogonal field components, circular polarization can be obtained as well as elliptic polarization.

It should be appreciated that various aspects of the exemplary embodiment 10 shown in FIG. 1 may be modified or changed according to design preference, without departing from the spirit and scope of this invention. For example, FIG. 1 illustrates a single input feed cable 18 feeding the feedpoint 17. Based on the type of design implemented, the energy conveyed by the input feed cable 18 may be moderated by a power dividing circuit or device, enabling transmission of the input feed cable's 18 energy to be fed to other devices or antenna systems. Similarly, while FIG. 1 illustrates a feedpoint 17 excitation scheme, as exemplied in U.S. Pat. No. 6,762,730, other schemes well known in the art, may be implemented as desired.

The exemplary embodiment 10 of FIG. 1 is illustrated as using substantially "non-solid" structures, for example, the backscreen 11 and the plate 12. According to design preferences, either and/or the backscreen 11 and the plate 12 may be solid, or alternatively, perforated in a different manner than as illustrated. Furthermore, the backscreen 11 and plate 12 are illustrated as being primarily planar in structure. As is well known in the art, structures such as the exemplary embodiment 10 shown in FIG. 1 are frequency sensitive. Therefore, based on the frequencies involved, the backscreen 11 and/or the plate 12 may be folded or angled about an axis of symmetry with respect to each other. Similarly, the parasitic dipole 15 may also be folded or curved to conform to the wavelength-sensitive dimensions of the exemplary embodiment 10.

Moreover, the parasitic dipole 15 may be affixed either to the plate 12 or to the backscreen 11, if so desired, by a plurality of supports or by a single support. It is understood that the supports 16 are non-conductive and can be attached to the parasitic dipole 15 in any number of ways, including, but not limited to, expoxying, friction couplings, screwings, etc. Manipulation of the offset or skew angle of the parasitic dipole 15 may be accomplished by rotating the parasitic dipole 15 about its supports 16 or by moving the supports 16 themselves. In FIG. 1, the parasitic dipole 15 is illustrated as having a slight northeasterly attitude. However, it should be appreciated that the parasitic dipole 15 may be oriented in any way desirable to produce the necessary complementary field components. Similarly, the feedpoint 17 may be oriented about a different horizontal axis of the slot 14, or, alternatively reversed from the orientation shown in FIG. 1.

Other variations to the exemplary embodiment 10 of FIG. 1 may include different orientations of the plate 12 with respect to the backscreen 11, alternative placements of the radiator/plate stand-offs 13, multiple or single radiator stand-offs 13, etc. By utilizing the combination of elements shown in FIG. 1, an antenna system having multi-frequency capabilities and circular polarization can be devised from a panel antenna.

Figure 3:
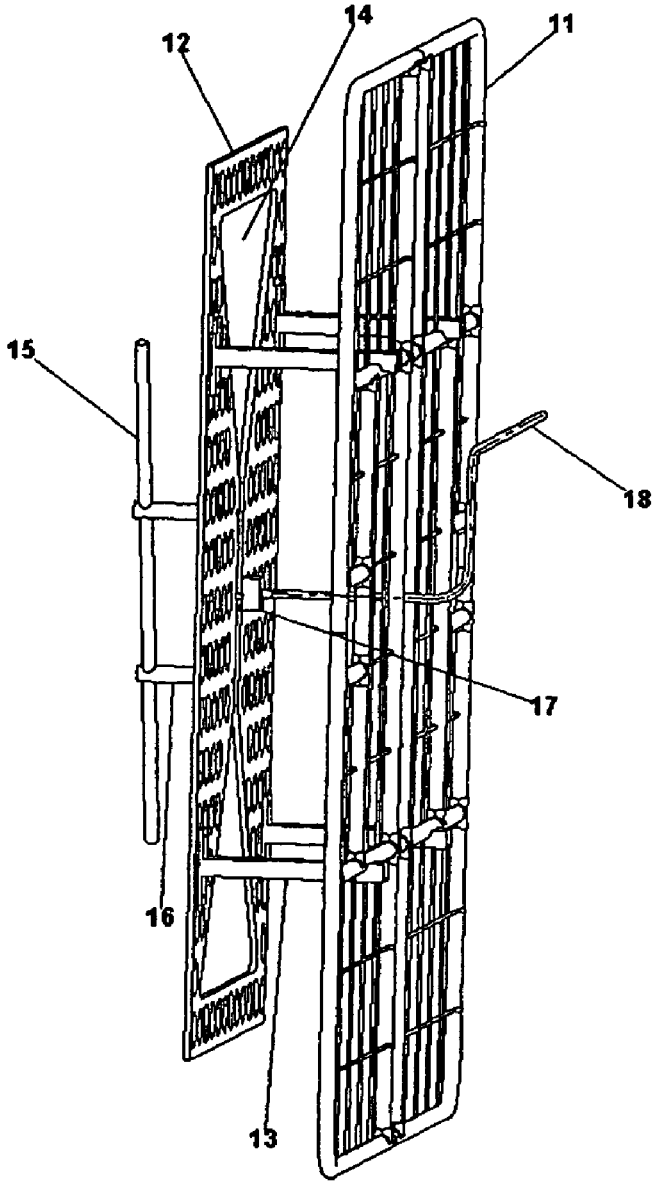
FIG. 3 is a perspective view illustrating the back plane of a circularly polarized panel antenna according a preferred embodiment of this invention.

FIG. 3 is a perspective view from the rear of the exemplary embodiment 10 shown in FIG. 1. FIG. 3 better illustrates the planar orientation of each of the various elements described in FIG. 1

Figure 4:
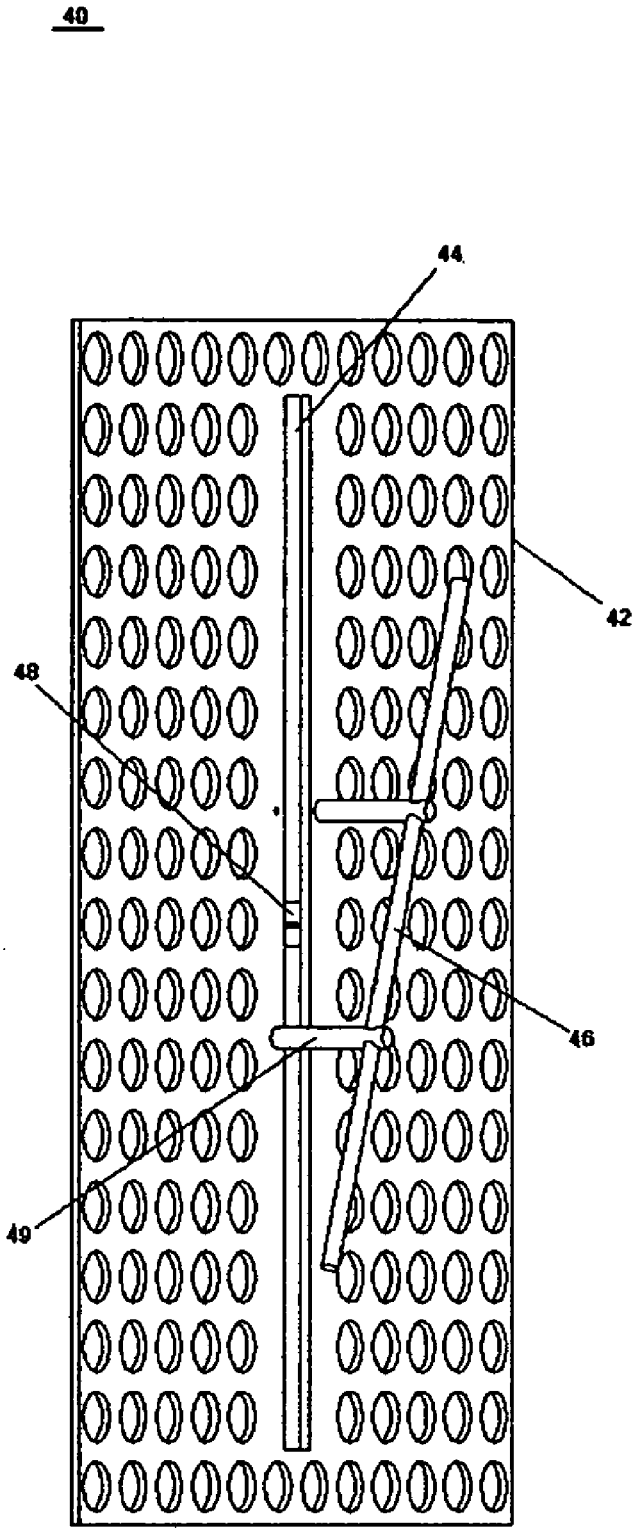
FIG. 4 is a front view of an array of circularly polarized panel antennas according to a preferred embodiment of this invention.

FIG. 4 is an illustration of another exemplary embodiment 40 of the invention, utilizing a different orientation of the panel's slot 44. The exemplary embodiment 40 contains a panel 42 with a horizontally oriented narrow band slot 44. The slot 44 is prefaced with a skewed dipole 46 across the general midpoint of the slot 44 and is supported by a dielectric or non-conductive support 49. The aperture formed by the slot 44 is excited by the slot junction source 48.

The operation of the exemplary embodiment 40 of FIG. 4 is similar to that described for the exemplary embodiment 10, above. However, as is clear from FIG. 4, the orientation of the narrow band slot 44 is horizontal. Consequently, the slot 44 will predominately generate vertical electric field components. The vertical electric field components will couple to the skewed dipole 46 and induce orthogonal field components, therein. The orthorgonal field components will be in the horizonal plane and will be radiated out in conjunction with the vertical field components from the slot 44. By judicious adjustment of the orientation of the skewed dipole's 46 angle of offset from the main axis of the slot 44, varying amounts of horizontal or orthogonal field components can be generated to result in an overall elliptic or circularly polarized wave front.

Figure 5:
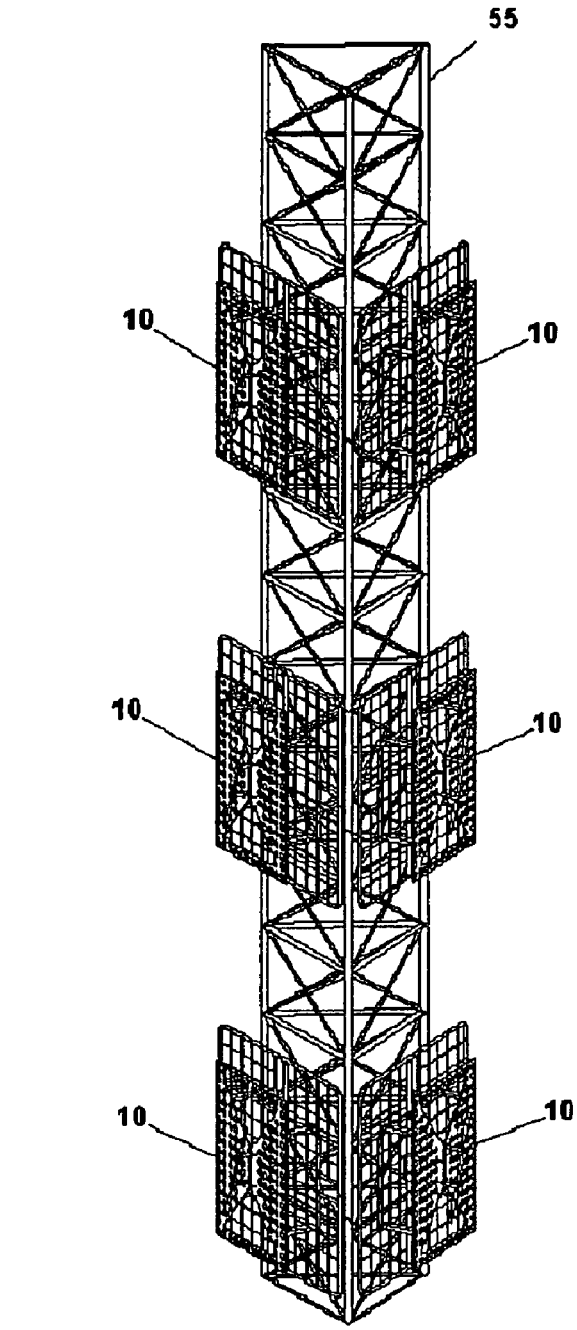
FIG. 5 is a front view of another exemplary embodiment of this invention.

FIG. 5 is an illustration of the exemplary embodiment 10 in an array configuration 50. The configuration 50 is shown with two sets of exemplary panel-based antennas 10 arrayed about a vertical axis of the supporting tower 55.

It should be appreciated that while the antenna configuration 50 of FIG. 5 is illustrated as having relatively symmetrical orientations, the antenna configuration 50 may be modified to enable any one or more of the exemplary antenna systems 10 to be re-oriented. For example, while the antenna configuration 50 illustrates the primary horizontal polarization field vector generator as the panel antennas 10, re-orientation of a desired antenna will result in the parasitic dipole as becoming the primary generator of horizontal electromagnetic radiation. Accordingly, a plurality of arrays as shown in FIG. 5 may be asymmetrically staggered either along an azmuthial angle of the tower 55 face or asymmetrically horizontally stacked about a face of the tower 55. Therefore, it should be appreciated that when implementing a plurality of broadband antenna systems, antenna pattern characteristics can be adjusted to achieve a desired geographic broadcast coverage. Similarly, by preferential arrangement of the antennas in an array, such as shown in FIG. 5, varying frequencies and modalities can be implemented. For example, an antenna dedicated to a particular band of frequencies, (e.g., FM) may be implemented within an array configured for "other" particular frequencies, (e.g., non-FM). Therefore, a single tower may be configured with a series of antenna arrays to provide both FM and television broadcast signals, or other signals, as desired.

It should be appreciated that upon reading the disclosure presented herein, the coupling efficiencies of the parasitic dipole 15, as discussed for example in FIG. 1, may be altered by one of several available degrees of freedom. Specfically, by manipulation of the offset angle of the parasitic dipole 15 from the vertical axis of bow-tie slot 14, the horizontal-to-vertical polarization conversion ratio can be proportionally affected. Additionally, coupling of the dipole 15 to the slot's 14 fields can be adjusted by moderating the distance between the dipole 15 and the face of the slot 14. Thus, based on desired performance characteristics, the dipole 15 may be configured as a single element or as an array of parasitic elements such as seen, for example, in log periodic arrays.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A broadcast panel antenna, comprising:

a substantially flat conductive panel having a bow-tie slot therein; and a parasitic element disposed substantially parallel to a plane of the panel, and displaced from the plane of the panel, and oriented at an angle that is skewed from an axis of symmetry of the bow-tie slot, wherein a midpoint of the parasitic element substantially crosses the axis of symmetry.

2. The antenna according to claim 1, further comprising:

an excitation source that crosses the axis of symmetry.

3. The antenna according to claim 1, further comprising:

a conductive ground screen disposed substantially parallel to the panel and on an opposite face of the panel from the parasitic element.

4. The antenna according to claim 3, wherein the panel is supported to the ground screen by a plurality of supports.

5. The antenna according to claim 1, wherein the parasitic element is supported by a plurality of non-conductive supports.

6. The antenna according to claim 1, wherein the dimensions of the bow-tie slot and the parasitic element correspond to television broadcast wavelengths.

7. The antenna according to claim 1, wherein the dimensions of the bow-tie slot and the parasitic element correspond to FM radio broadcast wavelengths.

8. The antenna according to claim 1, wherein the dimensions of the bow-tie slot and the parasitic element correspond to AM radio broadcast wavelengths.

9. The antenna according to claim 1, wherein the parasitic element is a dipole.

10. The antenna according to claim 1, wherein the angle of orientation of the parasitic element generates an orthogonal field component with respect to primary field components generated by the bow-tie slot.

11. The antenna according to claim 10, wherein a circularly polarized electromagnetic wave is produceable.

12. The antenna according to claim 10, wherein an elliptically polarized electromagnetic wave is produceable.

13. A broadcast panel antenna, comprising:

a first radiating means for radiating a first electromagnetic signal that exhibits a predominant first electromagnetic field orientation;

a second radiating means for radiating a second electromagnetic signal that exhibits a predominant second electromagnetic field orientation; and an imaging means for providing a ground plane effect, wherein the second radiating means is disposed substantially parallel to and displaced from a plane of the first radiating means, and oriented at an angle that is skewed from an axis of symmetry of the first radiating means and a midpoint of the first radiating means substantially crosses the axis of symmetry, and the imaging means is disposed substantially parallel to the first radiating means and on an opposite face of the first radiating means from the second radiating means.

14. The antenna according to claim 13, further comprising:

an electromagnetic field excitation means crossing the axis of symmetry for generating the first electromagnetic field orientation.

15. The antenna according to claim 13, wherein the first radiating means is coupled to the imaging means by a plurality of supporting means.

16. The antenna according to claim 13, wherein the second radiating means is supported by a plurality of non-conductive second radiating means supporting means.

17. The antenna according to claim 13, wherein the first and second radiating means are dimensioned to correspond to television broadcast wavelengths.

18. The antenna according to claim 13, wherein the first and second radiating means are dimensioned to correspond to FM radio broadcast wavelengths.

19. The antenna according to claim 13, wherein the first and second radiating means are dimensioned to correspond to AM radio broadcast wavelengths.

20. The antenna according to claim 13, wherein at least one of a circularly polarized and elliptically polarized electromagnetic wave is produced via the first and second radiating means.

21. A method for radiating a circularly polarized signal comprising the steps of:

generating a first predominant electromagnetic field orientation vector in a slotted panel radiator;

coupling the first vector to a parasitic element, and generating a second predominant electromagnetic field orientation vector from the parasitic element by orienting the parasitic element off-axis from the first vector, wherein the combination of the first and second vector produces a circularly polarized electromagnetic field.

22. The method according to claim 21, wherein the combination produces an elliptically polarized electromagnetic field.

23. The method according to claim 21, wherein an FM broadcast signal is generated.

24. The method according to claim 21, wherein a television broadcast signal is generated.

25. The method according to claim 21, wherein an AM broadcast signal is generated.

* * * * *